US008465318B2

(12) United States Patent
Kartes

(10) Patent No.: US 8,465,318 B2
(45) Date of Patent: Jun. 18, 2013

(54) CORD ORGANIZER DEVICE AND METHOD OF USE

(76) Inventor: Terry Lee Kartes, Fremont, MI (US)

( * ) Notice: Subject to any disclaimer, the term of this patent is extended or adjusted under 35 U.S.C. 154(b) by 107 days.

(21) Appl. No.: 12/949,089

(22) Filed: Nov. 18, 2010

(65) Prior Publication Data

US 2011/0130031 A1 Jun. 2, 2011

Related U.S. Application Data

(60) Provisional application No. 61/266,088, filed on Dec. 2, 2009.

(51) Int. Cl.
*A47F 7/00* (2006.01)

(52) U.S. Cl.
USPC ..... 439/501

(58) Field of Classification Search
USPC ..... 439/501, 367, 369; 206/224; 191/12.2 R; 242/378.4; 174/61, 154
See application file for complete search history.

(56) References Cited

U.S. PATENT DOCUMENTS

| | | | | |
|---|---|---|---|---|
| 4,183,603 | A * | 1/1980 | Donarummo | 439/369 |
| 5,913,487 | A * | 6/1999 | Leatherman | 242/378.4 |
| 6,305,388 | B1 * | 10/2001 | Zeller | 132/314 |
| 6,331,121 | B1 * | 12/2001 | Raeford, Sr. | 439/501 |
| 6,966,791 | B1 * | 11/2005 | Farr | 439/367 |
| 7,168,538 | B2 * | 1/2007 | Pena | 191/12.2 R |
| 7,513,361 | B1 * | 4/2009 | Mills, Jr. | 206/234 |
| 2009/0215322 | A1 * | 8/2009 | Omori | 439/692 |

* cited by examiner

*Primary Examiner* — Alexander Gilman
(74) *Attorney, Agent, or Firm* — Michael Ries

(57) ABSTRACT

The present invention is a cord organizer device that includes a horizontal base surface, spools to receive and control one or more power cords from one or more electrical devices, a plate with a distal end disposed on the top of the spools to label the spools and the power cords, holding clips that are disposed on the sides of the spools to secure the power cords against the horizontal base surface. There is also a cover that is disposed over the spools, the plates and the holding clips to protect and to hide the spools, the plates and the holding clips, a power strip to provide power to the device that is secured by a fastener to the horizontal base surface and a mounting hole to mount the device against a vertical surface.

10 Claims, 5 Drawing Sheets

CORD ORGANIZER DEVICE AND METHOD OF USE

This application claims priority to U.S. Provisional Application 61/266,088 filed on Dec. 2, 2009, the entire disclosure of which is incorporated by reference.

TECHNICAL FIELD & BACKGROUND

Many homes and businesses have an overabundance of exposed power cords. These power cords are not only unsightly, but they can also be a tripping hazard. Power cords from computers, DVD players, televisions and other electronic devices can become easily entangled with one another. When unplugging an electrical device, it can be frustrating trying to unravel the power cord.

The present invention generally relates to a cord organizer device and method of use. More specifically, the invention is a device designed to assist users in arranging and organizing multiple power cords that are running from various electronic devices.

It is an object of the invention to provide a device and method of use that prevents people from tripping over power cords.

It is an object of the invention to provide a cord organizing device and method of use that eliminates the occurrence of having cords from televisions, computers and other electronic devices from lying on a floor and becoming tangled.

It is an object of the invention to provide a cord organizing device and method of use that allows power cords to be neatly stored and hidden from view.

It is an object of the invention to provide a cord organizing device and method of use that offers a user a practical way to organize the power cords of their electronic devices.

What is really needed is a cord organizing device and method of use to assist users in arranging and organizing multiple power cords that are running from various electronic devices, that prevents people from tripping over power cords, that eliminates the occurrence of having cords from televisions, computers and other electronic devices from lying on a floor and becoming tangled, that allows power cords to be neatly stored and hidden from view and that offers users a practical way to organize the power cords of their electronic devices.

BRIEF DESCRIPTION OF THE DRAWINGS

The present invention will be described by way of exemplary embodiments, but not limitations, illustrated in the accompanying drawings in which like references denote similar elements and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention can be practiced with only some of the described aspects. For purposes of explanation, specific numbers, materials and configurations are set forth in order to provide a thorough understanding of the illustrative embodiments. However, it will be apparent to one skilled in the art that the present invention can be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it can. The terms "comprising", "having" and "including" are synonymous, unless the context dictates otherwise.

Figure 1A:
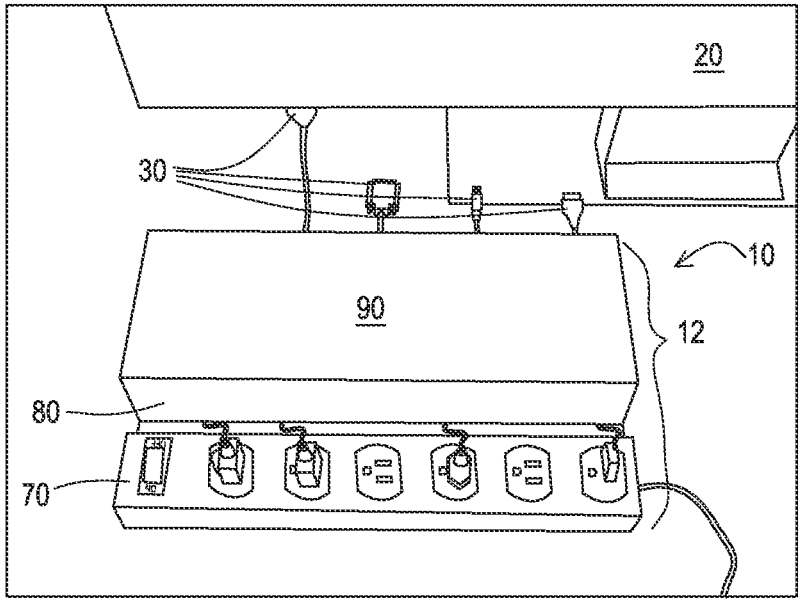
FIG. 1A illustrates a cord organizer device placed behind a television hiding a plurality of power cords, in accordance with one embodiment of the present invention.

FIG. 1A illustrates a cord organizer device 10 placed behind a television 20 hiding a plurality of power cords 30, in accordance with one embodiment of the present invention. The cord organizer device 10 is designed to assist a user (not shown) in arranging and organizing a plurality of power cords 30 that are running from various electronic devices. These electronic devices can include a television 20, a digital video disc player (not shown), a computer (not shown) and other electrical devices (not shown) with power cords that are well known to those skilled in the art. The cord organizer device 10 has a width 12 that is designed to accommodate the attachment of a power strip 70. The power strip 70 can be attached using a hook and loop fastener 80 or any other attachment assembly that is well known to those skilled in the art. The cord organizer device 10 can come in various sizes and dimensions with any number of spools 40 that are well known in the art. The cord organizer device 10 can be any color that is well known to those skilled in the art and the exact dimensions and specifications of the components of the cord organizer device 10 can be any dimensions and specifications that are well known to those skilled in the art. There is also a cover 90 that covers additional components of the cord organizer device 10 that are further discussed in FIGS. 1B, 1C and 1D.

Figure 1B:
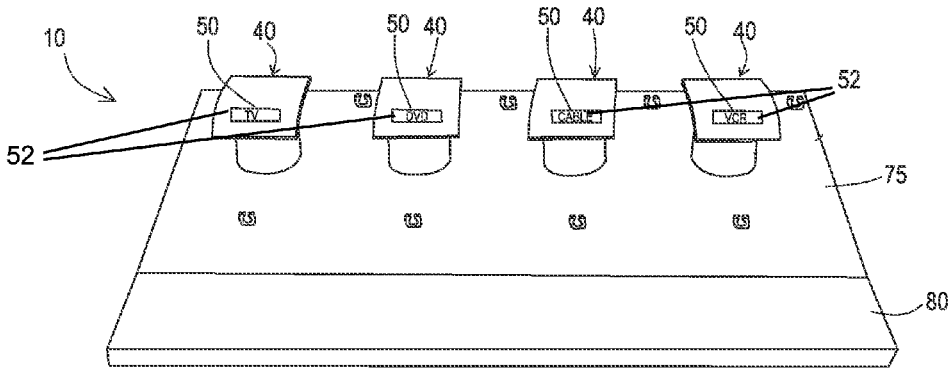
FIG. 1B illustrates a cord organizer device without a cover or power cords, in accordance with one embodiment of the present invention.
Figure 1C:
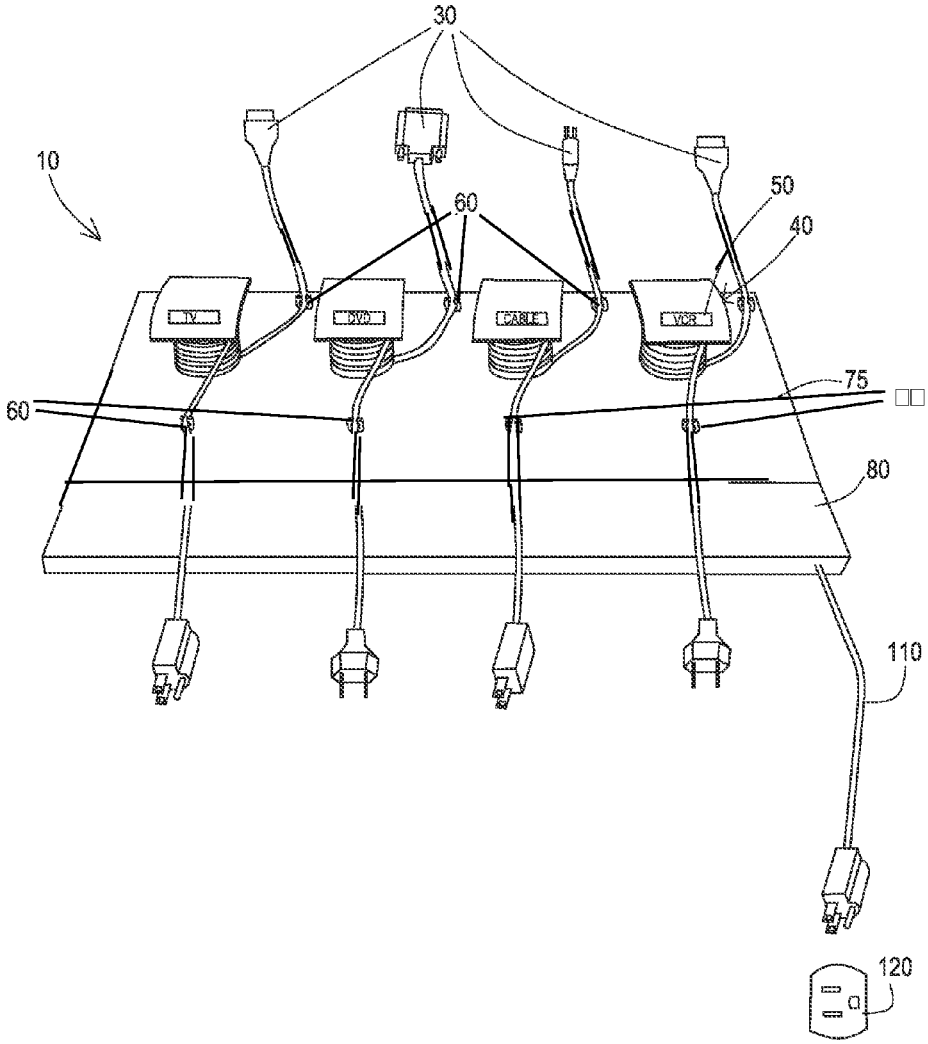
FIG. 1C illustrates a cord organizer device utilizing a plurality of power cords wrapped around a plurality of spools, in accordance with one embodiment of the present invention.

FIG. 1B illustrates a cord organizer device 10 without a cover 90 or a plurality of power cords 30, in accordance with one embodiment of the present invention. FIG. 1C illustrates a cord organizer device 10 utilizing a plurality of power cords 30 wrapped around a plurality of spools 40, in accordance with one embodiment of the present invention. The cord organizer device 10 is approximately 12" long, 7" wide, and 2.25" in height with approximately 4" of the width 12 containing a plurality of spools 40 approximately equally spaced 1.5" apart, although the spools 40 can be spaced any distance that is well known to those skilled in the art. The spools 40 are approximately 2" high, with a 1.5" by 2.5" plate 50 resting on top of each individual spool 40. The spools 40 and plate 50 can be any size that is well known to those in the art. These plates 50 are also slightly sloped downwards at their distal ends 52. The user can use this plate 50 to label which power cord 30 is wrapped around which spool 40 or any other information that is well known to those skilled in the art. There are holding clips 60 on both sides of the spools 40 to hold the power cord 30 as it enters and exits the spool 40. The spools 40 are resting on a horizontal base surface 75 and can also be covered by the cover 90 that will cover the spools 40. The user can also take a power cord 30 from an electronic device and secure the power cord 30 with a holding clip 60. The power cord 30 can then be wrapped around the spool 40 and then be secured with an additional holding clip 60. It can then be plugged into the power strip 70 or an extension cord 110 is used to provide power to the power cords 30 from an external power source, such as an electrical outlet 120. The spools 40 can also be labeled as desired by a user.

Figure 1D:
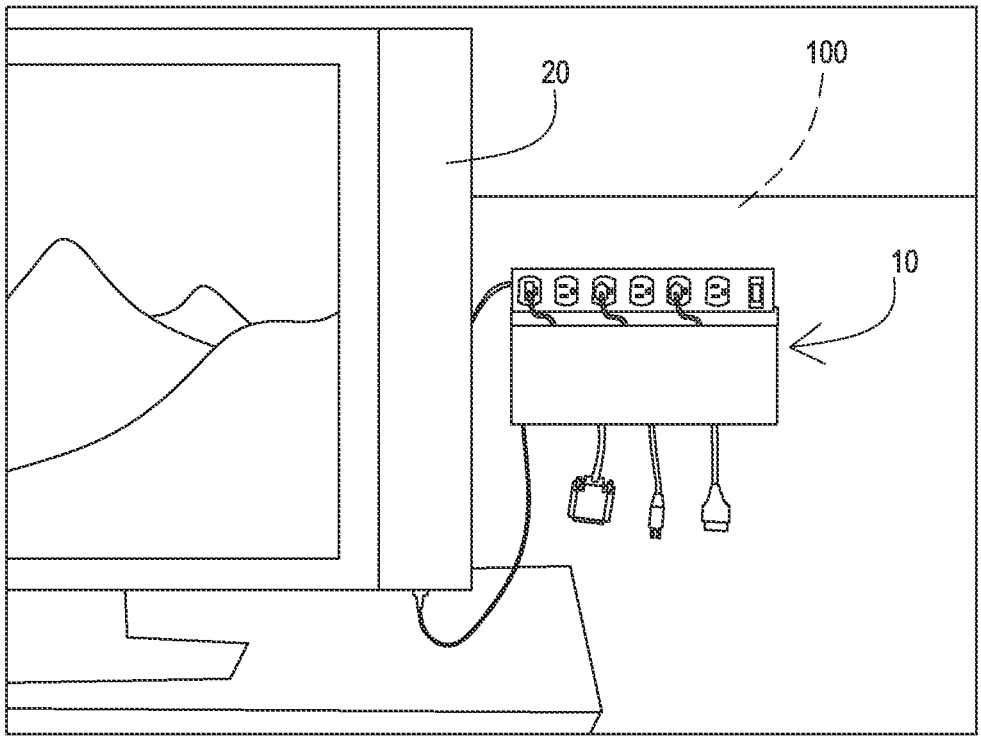
FIG. 1D illustrates a cord organizer device mounted on a wall, in accordance with one embodiment of the present invention.

FIG. 1D illustrates a cord organizer device 10 mounted on a wall, in accordance with one embodiment of the present invention. The cord organizer device 10 can have a mounting hole 100 between the second and third spool, towards the edge of the horizontal base surface 75, although the mounting hole 100 can be disposed anywhere on the horizontal base surface 75. The cord organizing device 10 can be hung on entertainment centers, cabinets, desks, walls and other vertical surfaces that are well known to those in the art. It can be mounted using screws, nails, hook and loop fasteners, or other mounting devices that are well known in the art.

Figure 2:
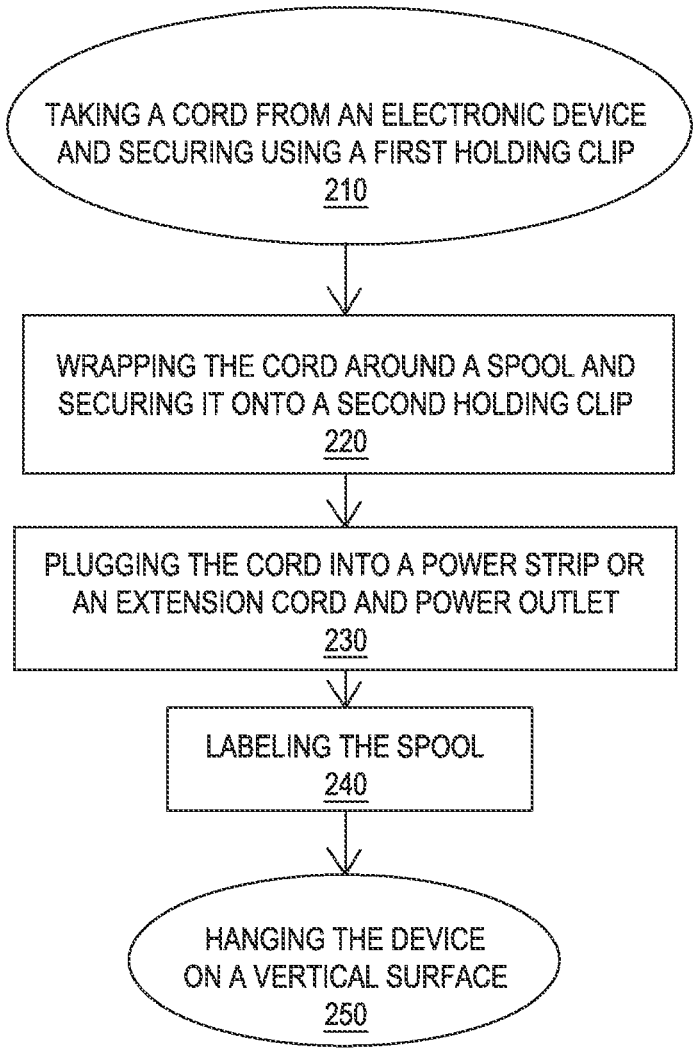
FIG. 2 illustrates a flow chart of a method of using a cord organizer device, in accordance with one embodiment of the present invention.

FIG. 2 illustrates a flow chart of a method of using a cord organizer device 200, in accordance with one embodiment of the present invention. The steps include a user taking a cord from an electronic device and securing it using a first holding clip 210, wrapping the cord around a spool and securing it with a second holding clip 220, plugging the cord into a power strip or an extension cord and power outlet 230, labeling the spool 240 and hanging the device on a vertical surface 250. The method step of hanging 250 includes the device is hung on the vertical surface using screws, nails or hook or loop fasteners. The user takes the cord from the electronic device and secures it with a first holding clip. The cord is wrapped around the spool and secured onto the horizontal base surface of the device with a second clip. It is then plugged into a power strip and/or extension cord. The spool is then labeled with the device's name or any other labeling indicia. The cord organizer device is then hung on the back of an entertainment center, a cabinet, a desk and even a wall. It is then mounted using screws, nails, hook and loop fasteners, or other mounting devices that are well known to those in the art.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

What is claimed is:

1. A cord organizer device, comprising:

a horizontal base surface;

a plurality of spools with a top and two sides, said spools to receive and control one or more power cords from one or more electrical devices;

each spool comprising a vertical rod extending from said base and a plate with a distal end, said plate rests on said top of each of said spools to label with an electrical device name indicia which said one or more power cords are wrapped around said spools and said plate is sloped downward at said distal end;

a plurality of holding clips disposed on said horizontal base surface to secure said one or more power cords against said horizontal base surface that enter and exit said spools;

a cover that is disposed over said spools, said plates and said holding clips, said cover to protect and to hide said spools, said plates and said holding clips;

a power strip to provide power to said cord organizer device, said power strip is secured by a hook and loop fastener to said horizontal base surface; and a mounting hole to mount said cord organizer device against a vertical surface.

2. The cord organizer device according to claim 1, wherein said one or more electrical devices include one or more televisions, one or more digital video disk players and one or more computers.

3. The cord organizer device according to claim 1, further comprising an extension cord utilized to provide power to said cord organizer device from an external power source.

4. The cord organizer device according to claim 1, wherein said vertical surface is an entertainment center, a cabinet, a desk or a wall.

5. The cord organizer device according to claim 4, wherein said cord organizer device is mounted on said vertical surface using one or more screws, one or more nails or one or more hook and loop fasteners.

6. A cord organizer device, utilized in combination with one or more electrical devices each with an electrical power cord, comprising:

a horizontal base surface;

a plurality of spools with a top and two sides, said spools to receive and control said power cords from said one or more electrical devices;

each spool comprising a vertical rod extending from said base and a plate with a distal end, said plate rests on said top of each of said spools to label with an electrical device name indicia which said one or more power cords are wrapped around said spools and said plate is sloped downward at said distal end;

a plurality of holding clips disposed on said horizontal base surface to secure said one or more power cords against said horizontal base surface that enter and exit said spools;

a cover disposed over said spools, said plates and said holding clips, said cover to protect and to hide said spools, said plates and said holding clips;

a power strip to provide power to said cord organizer device, said power strip that is secured by a hook and loop fastener to said horizontal base surface; and a mounting hole to mount said cord organizer device against a vertical surface.

7. The cord organizer device according to claim 6, wherein said one or more electrical devices include one or more televisions, one or more digital video disk players and one or more computers.

8. The cord organizer device according to claim 6, further comprising an extension cord utilized to provide power to said cord organizer device from an external power source.

9. The cord organizer device according to claim 6, wherein said vertical surface is an entertainment center, a cabinet, a desk or a wall.

10. The cord organizer device according to claim 9, wherein said cord organizer device is mounted on said vertical surface utilizing one or more screws, one or more nails or one or more hook and loop fasteners.

* * * * *